US010485290B2

(12) United States Patent
Parisotto

(10) Patent No.: US 10,485,290 B2
(45) Date of Patent: Nov. 26, 2019

(54) SKI BOOT

(71) Applicant: CALZATURIFICIO S.C.A.R.P.A. S.p.A., Asolo (IT)

(72) Inventor: Davide Parisotto, Casella d'Asolo (IT)

(73) Assignee: Calzaturificio S.C.A.R.O.A. S.P.A., Asolo (IT)

( * ) Notice: Subject to any disclaimer, the term of this patent is extended or adjusted under 35 U.S.C. 154(b) by 98 days.

(21) Appl. No.: 15/696,373

(22) Filed: Sep. 6, 2017

(65) Prior Publication Data

US 2018/0070672 A1 Mar. 15, 2018

(30) Foreign Application Priority Data

Sep. 9, 2016 (IT) ..... 102016000091373

(51) Int. Cl.
*A43B 5/04* (2006.01)

(52) U.S. Cl.
CPC ..... *A43B 5/0456* (2013.01); *A43B 5/0405* (2013.01); *A43B 5/047* (2013.01);
(Continued)

(58) Field of Classification Search
CPC ... A43B 5/0456; A43B 5/0462; A43B 5/0468; A43B 5/047; A43B 5/0474
(Continued)

(56) References Cited

U.S. PATENT DOCUMENTS 4,519,150 A * 5/1985 Arieh ..... A43B 5/0452 24/71 SK
4,821,433 A * 4/1989 Marxer ..... A43B 5/0456 36/118.7
(Continued)

FOREIGN PATENT DOCUMENTS

EP 0073433 A1 3/1983
EP 2486817 A1 8/2012
(Continued)

OTHER PUBLICATIONS

Search Report dated Jun. 30, 2017 from Italian Patent Application No. 102016000091373, filed Sep. 9, 2016.

*Primary Examiner* — Ted Kavanaugh
(74) *Attorney, Agent, or Firm* — David B. Tingey; Bryant J. Keller; Kirton McConkie

(57) ABSTRACT

A ski boot comprising: a rigid shell which is shaped so as to accommodate the foot of the user, and has a lower part structured to be able to couple to a ski binding device; a rigid cuff which is shaped so as to enclose the lower part of the leg of the user, and is pivotally joined to the shell so as to be able to swing about a rotation axis substantially perpendicular to the midplane of the boot; and a cuff locking device which is located on the cuff and is selectively adapted to rigidly connect the cuff to the shell to prevent the cuff from swinging on the shell; the cuff locking device, in turn, comprising a movable arm which is pivotally joined to the cuff so as to be able to rotate to and from a locking position in which the movable arm extends downwards and arranges its distal end in abutment on an anchorage structure present on said shell, and an elastic assembly which is adapted to bring and elastically retain the movable arm in the locking position, and which basically consists of a telescopic stem that lies substantially on the rotation plane of the movable arm and is interposed between the movable arm and a fixed point on the cuff, and of an elastic opposing member that is fitted on the telescopic stem, and acts on the telescopic stem so as to bring and elastically maintain the telescopic stem in a maximum extension configuration.

13 Claims, 2 Drawing Sheets

(52) U.S. Cl.
CPC ..... *A43B 5/049* (2013.01); *A43B 5/0474* (2013.01); *A43B 5/0492* (2013.01); *A43B 5/0496* (2013.01)

(58) Field of Classification Search
USPC ..... 36/117.4, 118.7, 118.8
See application file for complete search history.

(56) References Cited

U.S. PATENT DOCUMENTS

| | | | | | |
|---|---|---|---|---|---|
| 4,839,973 | A * | 6/1989 | Dodge | A43B 5/0452 | 36/118.7 |
| 5,065,533 | A * | 11/1991 | Paris | A43B 5/0474 | 36/118.1 |
| 5,136,794 | A * | 8/1992 | Stampacchia | A43B 5/0474 | 36/118.7 |
| 2010/0229425 | A1* | 9/2010 | Parisotto | A43B 5/04 | 36/117.1 |
| 2014/0013629 | A1* | 1/2014 | Haugen | A43B 5/0456 | 36/117.1 |
| 2015/0033586 | A1* | 2/2015 | Parisotto | A43B 5/0456 | 36/117.1 |
| 2016/0324252 | A1* | 11/2016 | Viniero | A43B 5/0474 | |
| 2016/0345658 | A1* | 12/2016 | Grandin | A43B 5/047 | |
| 2018/0368508 | A1* | 12/2018 | Gorza | A43B 5/0474 | |

FOREIGN PATENT DOCUMENTS

| | | | |
|---|---|---|---|
| FR | 2341283 | A1 | 9/1977 |
| WO | 2013/150489 | A1 | 10/2013 |

* cited by examiner

SKI BOOT

PRIORITY CLAIM

This application claims priority from Italian Patent Application No. 102016000091373 filed on Sep. 9, 2016, the disclosure of which is incorporated by reference.

TECHNICAL FIELD

The present invention relates to a ski boot.

In more detail, the present invention relates to a mountaineering or Telemark ski boot. Use to which the following description will make explicit reference without thereby losing generality.

BACKGROUND OF THE INVENTION

As is known, the most recent mountaineering ski boots basically comprise: a rigid shell made of plastic material, which is shaped substantially like a shoe so as to accommodate the foot of the user, and has the lower part specifically structured to be fixed to the back of a downhill ski or the like by means of a suitable mountaineering ski binding device; a rigid cuff made of plastic material, which is shaped so as to embrace the lower part of the leg of the user from behind, and is hinged to the upper part of the shell so as to be able to rotate about a transversal reference axis, which is substantially perpendicular to the vertical midplane of the ski boot, and is also locally substantially coincident with the articulation axis of the ankle; and an innerboot made of a soft and thermal-insulating material, which is inserted inside the shell and the cuff, and is shaped so as to enclose and protect both the foot and the lower part of the leg of the user.

The mountaineering ski boots mentioned above are additionally provided with shell closing means and cuff closing means, both manually operated. The shell closing means are structured so as to be able to selectively close/tighten the shell on the foot of the user, thus to immobilize the foot of the user inside the shell, or rather the innerboot. The cuff closing means, in tune, are structured so as to be able to selectively close/tighten the upper part of the cuff on the leg of the user, thus to immobilize the leg of the user inside the cuff, or rather the innerboot.

Finally, the mountaineering ski boots also include a manually-operated cuff locking device which is traditionally placed in the area above the heel of the boot, and is structured so as to be able to selectively and alternately lock the cuff to the shell in a rigid manner thus to prevent any pivoting movement of the cuff on the shell; or fully release the cuff from the shell so to allow the cuff to freely pivot on the shell.

In the most modern mountaineering ski boots, the cuff locking device is basically made up of an oblong movable arm which is butt hinged to the cuff above the heel of the boot so as to be able to rotate while remaining on the midplane of the boot, and is movable to and from a locking position in which the arm extends downwards skimming the outer surface of the cuff and places its distal end in abutment against the rear of the shell, more or less in the area of the heel; and an elastic member acting on the arm so as to push and elastically retain the arm alternately in the locking position or in an unlocking position in which the arm is rotated upwards so as to raise and move the distal end of the arm away from the shell. The distal end of the arm, in turn, is structured so as to be able to firmly couple to the shell at a predetermined anchorage point, so that the arm can prevent any oscillation of the cuff on the shell.

In most mountaineering ski boots currently on the market, the elastic member consists of a small leaf spring which acts directly on the proximal end of the arm.

While working excellently, the leaf spring is not able to apply a great elastic force on the arm, and this can unfortunately cause some problems when the user actuates the cuff locking device under particularly adverse environmental conditions.

Experimental tests, in fact, have shown that in some cases the leaf spring fails to apply an elastic thrust sufficient to allow the distal end of the arm to cut through the snow that traditionally accumulates on the rear of the shell, and reach the anchorage point.

SUMMARY OF THE INVENTION

Aim of the present invention is to provide a cuff locking device which is free from the drawbacks mentioned above and is also cheap to produce.

In compliance with these aims, accordance to the present invention there is provided a ski boot as defined in claim 1 and preferably, though not necessarily, in any one of the claims dependent thereon.

BRIEF DESCRIPTION OF THE DRAWINGS

The present invention will now be described with reference to the accompanying drawings, which illustrate a non-limiting embodiment thereof, in which:

FIG. 2 is a view in enlarged scale of the rear part of the mountaineering ski boot of FIG. 1, in a second operating configuration; whereas

DETAILED DESCRIPTION OF THE INVENTION

Figure 1:
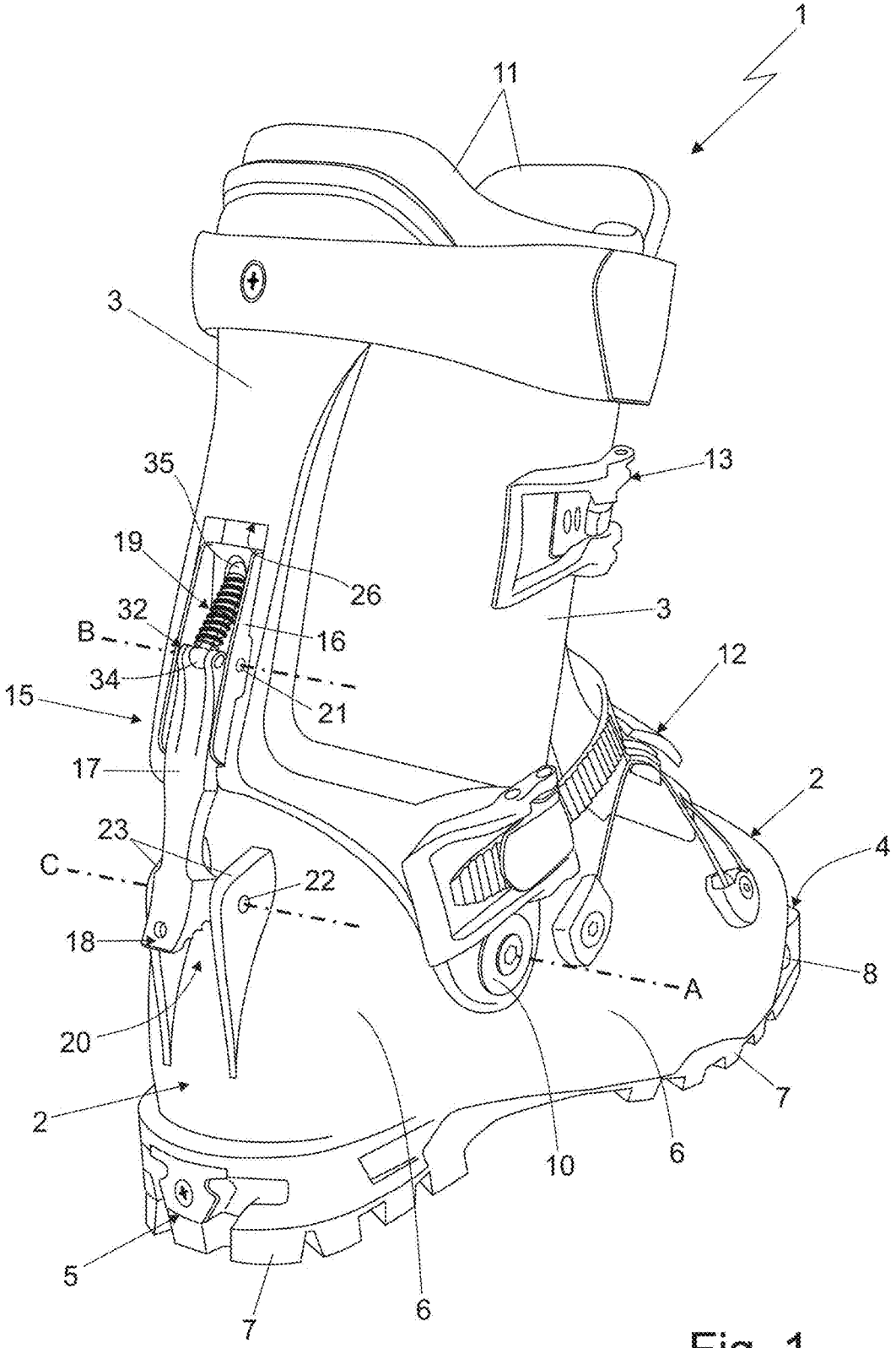
FIG. 1 is a perspective view of a mountaineering ski boot realized according to the teachings of the present invention, with parts removed for clarity.
Figure 2:
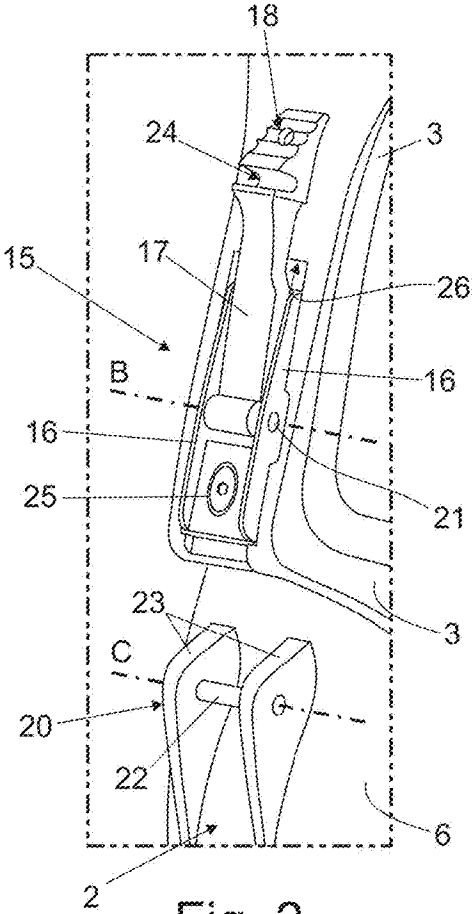

With reference to FIGS. 1 and 2, number 1 denotes, as a whole, a ski boot that can advantageously be used for practicing ski mountaineering or Telemark.

The ski boot 1 firstly comprises: a rigid shell 2 preferably made of a plastic and/or composite material, which is shaped substantially like a shoe so as to accommodate the foot of the user, and has a lower part specifically shaped/structured to couple/fasten in a rigid and stable, though easily releasable manner, to a ski binding device (not shown) of a known type which, in turn, is adapted to be fixed in rigid manner to the back of a generic downhill ski or the like; and a rigid cuff 3 preferably made of a plastic and/or composite material, which is shaped so as to enclose the lower part of the leg of the user, and is pivoted on the upper part of the 2 so as to be able to freely swing about a transversal rotation axis A, which is locally substantially perpendicular to the vertical midplane of the boot, and is also substantially coincident with the articulation axis of the user's ankle.

More specifically, the lower part of shell 2 is preferably has a front tip 4 and a rear heel 5. The front tip 4 is preferably structured so as to be able to couple/fasten in a stable, though easily releasable manner to the toe piece (not shown) of a ski binding device, which in turn is firmly fixed to the back of a generic downhill ski or the like. Instead, the rear heel 5 is preferably structured so as to be able to couple/fasten in a stable, though easily releasable manner to the heel piece (not shown) of the same ski binding device, which in turn is firmly fixed to the back of a generic downhill ski or the like.

Preferably, the lower part of shell 2 additionally has a treaded profile so to grip on snow and/or ice and thus allow the user to relatively safely walk on snow and ice.

In the example shown, in particular, the front tip 4 of shell 2 is preferably structured so as to be able to couple/fasten in known manner to the toe piece of a ski mountaineering binding device; whereas the rear heel 5 of shell 2 is preferably structured so as to be able to couple/fasten in a known way to the heel piece of the same ski mountaineering binding device.

In more detail, with reference to FIGS. 1 and 2, the shell 2 preferably comprises: a substantially basin-shaped, rigid casing 6 which is made of a plastic and/or composite material and is shaped so as to accommodate, enclose and protect the foot of the user roughly up to the height of the ankle; and optionally also a bottom sole 7 preferably having a treaded profile, which is made of vulcanized rubber or other elastomeric material with a high friction coefficient, and is firmly fixed to the bottom wall of casing 6 preferably by gluing.

With reference to FIG. 1, moreover the shell 2 preferably also comprises a front rigid insert 8 preferably having a substantially plate-like structure, which is preferably made of metal material and is stably embedded/incorporated within the bottom wall of rigid casing 6 roughly at the tip 4 of shell 2. The rigid insert 8 is additionally dimensioned so as to emerge/surface outside the casing 6 on opposite sides of the front tip 4 of shell 2, roughly in a specular position with respect to the midplane of the boot, so that the two distal ends of the rigid insert 8 can couple in a known manner to the toe piece of the ski mountaineering binding device.

With reference to FIGS. 1 and 2, cuff 3 in turn preferably basically consists of a rigid casing made of plastic or composite material, which is substantially C-folded so as to cover the back of the leg of the user, from the ankle substantially up to the height of the calf, and is also provided with two oblong lateral flaps (not visible in the figures) which extend forwards on opposite sides of the midplane of the boot, so as to embrace the leg of the user from behind roughly at calf height, and then preferably overlap one another at the front of the leg, thus forming a tubular structure that surrounds the leg of the user at height of the calf.

In addition, the cuff 3 is preferably fixed in freely rotatable manner to the upper part of the shell 2, or rather of rigid casing 6, by means of two connecting hinges 10 preferably made of a metallic material, which are located on the inner and outer lateral sides of shell 2 and of cuff 3, aligned along the rotation axis A, so as to allow the cuff 3 to freely swing on the shell 2 both forwards and backwards, while remaining on a reference plane orthogonal to axis A and substantially coincident with the midplane of the ski boot.

With reference to FIG. 1, in addition the ski boot 1 preferably also comprises an innerboot 11 with a soft and thermal-insulating structure, which is shaped so as to accommodate and protect the foot of the user and optionally also the lower part of the leg of the user, and is inserted inside the shell 2 and optionally also inside the cuff 3, preferably in a manually removable manner.

More in detail, in the example shown the innerboot 11 is preferably shaped so as to accommodate, cover and protect the foot of the user and in addition also the lower part of the leg of the user, roughly up to the top of the calf. Preferably, the innerboot 11 also has a thermoformable-type structure.

With reference to FIG. 1, in addition the ski boot 1 preferably also comprises shell closing means 12 and/or cuff closing means 13, both manually operated.

The shell closing means 12 are structured so as to be able to selectively close/tighten the shell 2 on the foot of the user in order to immobilize the foot of the user inside the shell 2, or rather inside the innerboot 11. The cuff closing means 13, in turn, are structured so as to be able to selectively close/tighten the upper part of cuff 3 on the leg of the user, in order to immobilize the leg of the user inside the cuff 3, or rather inside the innerboot 11.

With reference to FIGS. 1 and 2, the ski boot 1 is finally provided with a manually operated cuff locking device 15 which is placed on the cuff 3 preferably in the area above the heel of the boot, and is structured so as to be able to selectively connect the cuff 3 in rigid manner to the shell 2, so as to prevent the cuff 3 from freely pivoting about the axis A.

In more detail, the cuff locking device 15 is preferably rigidly fixed to the cuff 3 in the area above the heel of the boot, preferably substantially straddling the midplane of the boot.

In addition, the cuff locking device 15 is preferably structured so as to be able to selectively and alternately:

- lock the cuff 3 in rigid manner to the shell 2 in a predetermined descent position, in which the cuff 3 is tilted forward with respect to the vertical, preventing at the same time any swinging movement of the cuff 3 on the shell 2 about axis A; and
- fully unlock/release the cuff 3 from the shell 2 so as to allow the cuff 3 to freely swing back and forth on the shell 2 about axis A, while remaining on the midplane of the boot.

In the example shown, in particular, the cuff locking device 15 is preferably structured so as to be able to lock the cuff 3 in rigid manner to the shell 2 in a predetermined descent position in which the cuff 3 is tilted forward with respect to the vertical by an angle preferably, though not necessarily, ranging between 3° and 30°.

With reference to FIGS. 1, 2, 3 and 4, the cuff locking device 15 comprises: a support plate 16 which is preferably made of metal material and is rigidly fastened to the cuff 3, preferably substantially straddling the midplane of the boot; a rigid and oblong movable arm 17, preferably made of a metallic material, which is hinged to the support plate 16 so as to be able to rotate with respect to the support plate 16 while remaining on a lying plane preferably substantially coinciding with the midplane of the boot, to and from a locking position (see FIG. 1) in which the arm 17 extends downwards, preferably substantially skimming the outer surface of cuff 3, and places its distal end 18 in abutment against the rear part of shell 2; and an elastic assembly 19 which is interposed between support plate 16 and arm 17, and is structured so as to bring and elastically retain the arm 17 in the locking position.

The distal end 18 of arm 17, furthermore, is structured so as to be able to couple/fasten, when the arm is in the locking position, in a rigid and stable, though easily releasable manner, to an anchorage structure 20 which is located on shell 2, beneath the cuff locking device 15, substantially straddling the rotation plane of the arm 17.

In other words, the anchorage structure 20 is preferably located on shell 2, more or less at the heel of the boot.

In this way, when it is in the locking position, the movable arm 17 extends like a bridge between shell 2 and cuff 3 connecting the two elements in rigid manner one to the other In more detail, the arm 17 is preferably hinged on the support plate 16 so as to be able to rotate about a transversal rotation axis B which is locally substantially perpendicular to the midplane of the boot and therefore substantially parallel to axis A, between a locking position (see FIG. 1) in which the arm 17 extends downwards, substantially skimming the outer surface of the cuff 3, and places its distal end 18 in abutment against the rear part of shell 2, so that the distal end 18 can couple to the anchorage structure 20; and an unlocking position (see FIG. 2) in which the arm 17 is rotated upwards so as to raise and move away/space the distal end 18 from the anchorage structure 20 of shell 2.

In more detail, with reference to FIG. 2, in the unlocking position the arm 17 is preferably rotated upwards with respect to the locking position by about 160°, so as to extend upwards more or less skimmed over the outer surface of cuff 3.

Elastic assembly 19, in turn, is preferably structured so as to be able to elastically retain the arm 17 both in the locking position and in the unlocking position.

Preferably, the arm 17 is moreover butt hinged to the support plate 16. The support plate 16, on the other hand, is preferably fixed to the cuff 3 in a manually adjustable manner.

In more detail, with reference to FIGS. 1, 2, 3 and 4, the movable arm 17 is preferably butt hinged to the support plate 16 by means of a transversal pin 21 which extends coaxially to axis B, engaging in sequence the support plate 16 and the proximal end of the arm 17.

Preferably, the distal end 18 of arm 17, in turn, is structured so as to be able to couple in rigid and stable, though easily releasable manner, to an anchoring pin 22 preferably made of metal material, which is rigidly fixed to the shell 2 more or less at the heel of the boot, substantially straddling the rotation plane of the arm 17, i.e. substantially straddling the midplane of the boot.

In more detail, with reference to FIGS. 1, 2, 3 and 4, in the example shown, the pin 22 preferably extends skimming the shell 2 while remaining coaxial to a transversal reference axis C that is locally substantially perpendicular to the midplane of the boot and, therefore, substantially parallel to axis A and/or B. In addition, the transversal pin 22 is preferably supported at its two ends by a pair of plate-like wings 23 that jut out from the casing 6 of shell 2, on opposite sides of the midplane of the ski boot, preferably while remaining locally substantially coplanar with the same midplane.

The distal end 18 of arm 17, on the other hand, is preferably provided with a rectilinear transversal slot or groove 24 which is dimensioned so as to accommodate the central segment of pin 22.

In the example shown, therefore, the anchorage structure 20 preferably comprises the transversal pin 22 and the two supporting wings 23.

With reference to FIGS. 1, 2, 3 and 4, the support plate 16, on the other hand, is preferably has approximately rectangular in shape, and is preferably stably retained in abutment on the outer surface of the cuff 3 by means of one or more anchoring screws 25 which preferably extend perpendicular to the laying plane of support plate 16.

More in detail, in the example shown the support plate 16 is preferably at least partially accommodated within a seat or recess 26 which is realized on the body of cuff 3, above the heel of the ski boot and substantially straddling the midplane of the boot, and is preferably retained in abutment against the bottom of the recess 26 by means of an anchoring screw 25.

Preferably, the support plate 16 is moreover retained in abutment against the cuff 3, or rather against the bottom of the recess 26, in a manually adjustable manner.

In more detail, the lower abutting surface 27 of support plate 16 is preferably provided with a toothed profile which is shaped so as to be able to engage with a corresponding toothed profile (not shown in the figures) present on the bottom of recess 26, in a series of positions freely selectable by the user.

Figure 4:
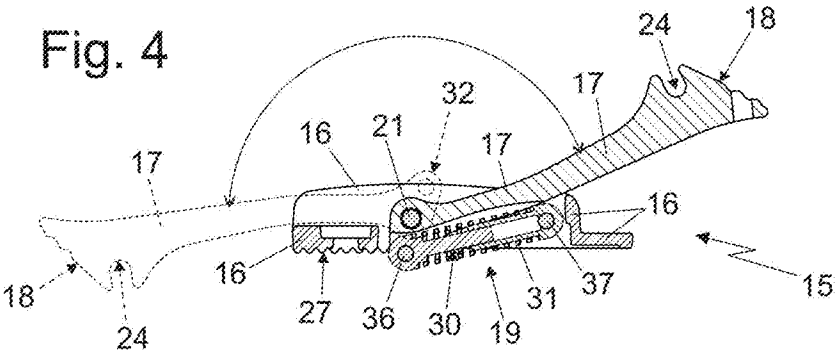
FIGS. 3 and 4 show the cuff locking device of the mountaineering ski boot of FIG. 1, in two different operating configurations and with parts in section and parts removed for clarity.
Figure 3:
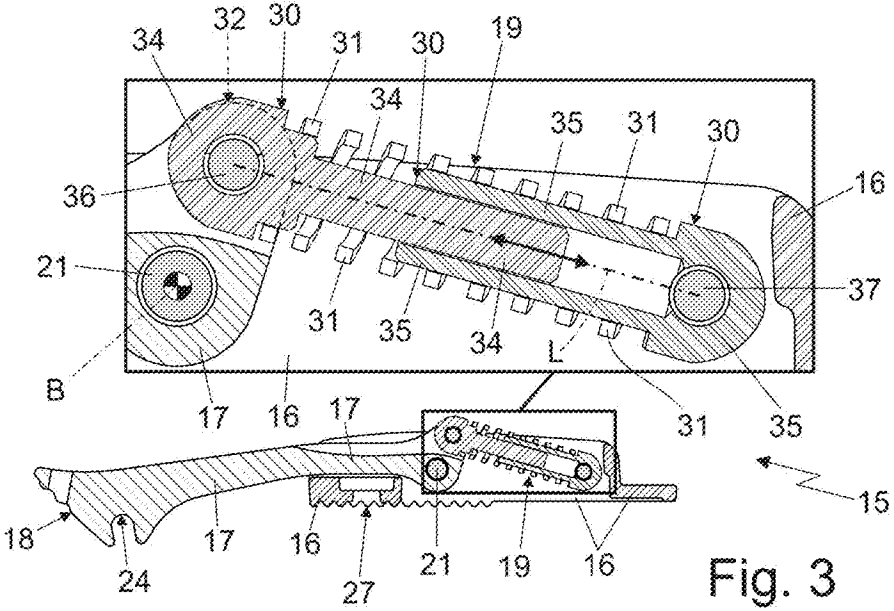

With reference to FIGS. 1, 3 and 4, the elastic assembly 19 in turn comprises: a straight telescopic stem 30 which lies substantially on the rotation plane of movable arm 17, and has the two axial ends pivotally joined one to the arm 17 at a predetermined distance from the arm rotation axis B, i.e. in an eccentric position with respect to axis B, and the other to the support plate 16, so as to be able to rotate freely relative to the two elements; and an elastic opposing member 31 which is fitted on telescopic stem 30, and acts on telescopic stem 30 so as to bring and elastically maintain the telescopic stem 30 in a maximum extension configuration.

In more detail, the arm 17 is preferably provided with a transverse fork 32 that projects in cantilever manner from the proximal end of the arm in a direction substantially perpendicular to rotation axis B, and the telescopic stem 30 is hinged to the end of the fork 32, obviously at a predetermined distance from axis B.

Preferably, the telescopic stem 30 moreover comprises at least one rod 34 and a sheath 35 which extend coaxial to the stem longitudinal axis L, and are inserted in telescopic manner one into the other.

The rod 34 is preferably made of metal material and is preferably butt hinged on the body of arm 17, or rather on the fork 32 jutting out from the proximal end of arm 17, in an eccentric position with respect to the axis B, by means of a first transversal pass-through pin 36 that extends parallel to axis B.

Similarly, the sheath 35 is preferably made of metal material and is preferably butt hinged to the support plate 16 by means of a second transversal pass-through pin 37 that extends parallel to axis B.

Obviously, in a different embodiment, the rod 34 may be butt hinged to support plate 16, and the sheath 35 may be butt hinged to the body of arm 17, or rather to the fork 32 jutting out from the proximal end of arm 17, in an eccentric position with respect to axis B.

With reference to FIGS. 3 and 4, preferably the elastic member 31, in turn, includes a preferably preloaded in compression, coil spring which is fitted onto the telescopic stem 30, with the two axial ends abutting one on the body of rod 34 and the other on the body of sheath 35, preferably close the two axial ends of telescopic stem 30, so as to hinder the entry of rod 34 into sheath 35.

In more detail, a first end of coil spring 31 is preferably arranged in abutment against the body of rod 34 at an annular shoulder realized close to the transversal pass-through pin 36. A second end of coil spring 31 is preferably arranged in abutment against the body of sheath 35 at an annular shoulder realised close to the transversal pass-through pin 37.

General operation of ski boot 1 is easily inferable from the above description and requires no further explanations.

As regards instead the cuff locking device 15, the user can manually move the movable arm 17 from the locking position to the unlocking position and vice versa, depending on whether he/she wishes to rigidly lock the cuff 3 to the shell 2. The action of elastic assembly 19 allows to automatically complete the movement of the movable arm 17 into any one of the two positions.

The advantages correlated to the cuff locking device 15 are remarkable.

Firstly, the particular structure of the elastic assembly 19 allows to apply to the movable arm 17 a very high torque which is able to place the movable arm 17 in the locking position even when the rear of the boot is covered with a thick layer of icy snow.

The coil spring 31, in fact, is capable of applying a far greater elastic force than a leaf spring of similar size.

Moreover, the cuff locking device 15 has extremely reduced weight and dimensions, with the advantages that this entails in terms of the overall weight of the ski boot 1.

Last, but not least, the cuff locking device 15 has production costs comparable to those of the already-known cuff locking devices, with all the advantages that this entails.

Finally, it is clear that modifications and variants may be made to the above-described ski boot 1 without however departing from the scope of the present invention.

For example, in a different embodiment, the elastic member 31 may also include a Belleville spring and/or a sleeve made of an elastomeric material, still fitted onto the telescopic stem 30.

In addition, a jacket or coating made of a high friction coefficient material may be placed on the outer surface of rod 34 so as to increase the friction between rod 34 and sheath 35. This makes it possible to slow down by friction the axial movements of the rod 34 inside the sheath 35.

In more detail, one or more elastomeric-material rings may be advantageously fitted on the portion of rod 34 that slides inside the sheath 35.

In addition or alternatively, the inner surface of the sheath 35 could also be covered with a jacket made of a high friction coefficient material, so as to slow down by friction the axial movements of the rod 34 inside the sheath 35.

Lastly, according to a less sophisticated embodiment, the cuff locking device 15 may lack the support plate 16. In this case, the movable arm 17 is butt hinged directly on the body of cuff 3, and the elastic assembly 19 is interposed between movable arm 17 and cuff 3.

In other words, in this embodiment the telescopic stem 30 has a first end hinged on the body of arm 17, or rather on the fork 32 jutting out from the proximal end of arm 17, in an eccentric position with respect to axis B; and a second end hinged directly on the body of cuff 3.

The invention claimed is:

1. A ski boot comprising: a rigid shell which is shaped so as to accommodate a foot of a user, and has a lower part structured to be able to couple to a ski binding device; a rigid cuff which is shaped so as to enclose a lower part of a leg of the user, and is pivotally joined to the shell so as to be able to swing about a rotation axis substantially perpendicular to a midplane of the boot; and a cuff locking device which is placed on the cuff and is selectively adapted to rigidly connect the cuff to the shell to prevent the cuff from swinging on the shell;

the cuff locking device in turn comprising: a movable arm which is pivotally joined to the cuff so as to be able to rotate to and from a locking position in which the movable arm extends downwards and arranges its distal end in abutment on an anchorage structure present on said shell; and an elastic assembly adapted to bring and elastically retain the movable arm in the locking position;

the ski boot being characterised in that the elastic assembly comprises: a telescopic stem that lies substantially on a rotation plane of the movable arm, the telescopic stem including at least one rod and a sheath inserted one into the other in telescopic manner, and having a first axial end pivotally joined to and at the movable arm in an eccentric position with respect to a rotation axis of the movable arm, and a second axial end pivotally joined to a fixed point on the cuff; and an elastic opposing member which is fitted over the telescopic stem, and acts on the telescopic stem so as to bring and elastically maintain the telescopic stem in a maximum extension configuration.

2. The ski boot according to claim 1, characterised in that the elastic opposing member includes a coil spring and/or a sleeve made of elastomeric material.

3. The ski boot according to claim 2, characterised in that the coil spring is preloaded in compression.

4. The ski boot according to claim 1, characterised in that the movable arm is butt pivoted to the cuff.

5. The ski boot according to claim 1, characterised in that the movable arm is provided with a transversal fork that projects in a cantilevered manner from the proximal end of the arm, and the telescopic stem is hinged on said fork.

6. The ski boot according to claim 1, characterised in that the at least one rod and the sheath extend coaxially to a longitudinal axis of the stem.

7. The ski boot according to claim 1, characterised in that the movable arm is hinged on a support plate which, in turn, is rigidly fastened on the cuff.

8. The ski boot according to claim 7, characterised in that the telescopic stem is hinged on said support plate.

9. The ski boot according to claim 7, characterised in that the support plate is stably retained in abutment on the cuff by one or more anchoring screws.

10. The ski boot according to claim 7, characterised in that the support plate is stably retained in abutment on the cuff in a manually adjustable way.

11. The ski boot according to claim 7, characterised in that the support plate is at least partially housed inside a seat or recess realized on the body of the cuff.

12. The ski boot according to claim 1, characterised in that the distal end of the movable arm is adapted to couple/fasten in a rigid and stable, though easily releasable manner, to said anchorage structure.

13. The ski boot according to claim 1, characterised in that the cuff locking device is located on the cuff in an area over a heel of the boot, substantially straddling the midplane of the boot, and in that the anchorage structure is located on the shell substantially at the heel of the boot.

* * * * *